US005249325A

United States Patent [19]

Wilen

[11] Patent Number: 5,249,325

[45] Date of Patent: Oct. 5, 1993

[54] BRUSH AND BONNET CARPET CLEANING ASSEMBLY

[75] Inventor: Joseph M. Wilen, Atlanta, Ga.

[73] Assignee: Wilen Manufacturing Co., Inc., Atlanta, Ga.

[21] Appl. No.: 995,954

[22] Filed: Dec. 23, 1992

Related U.S. Application Data

[63] Continuation of Ser. No. 823,022, Jan. 15, 1992, abandoned, and a continuation of Ser. No. 600,009, Oct. 18, 1990, abandoned.

[51] Int. Cl.[5] ..... A47L 11/162; A47L 11/34

[52] U.S. Cl. ..... 15/4; 15/50.1; 15/98; 15/118; 15/180; 15/230; 15/230.17; 51/358

[58] Field of Search ..... 15/4, 28, 29, 41.1, 15/49.1, 50.1, 98, 118, 180, 230, 230.14–230.19, 246, 385; 51/177, 358, 388, 401

[56] References Cited

U.S. PATENT DOCUMENTS

| | | | |
|---|---|---|---|
| 1,498,255 | 6/1924 | Winchester | 15/50.1 X |
| 1,654,036 | 12/1927 | Carpenter | 15/180 |
| 1,988,193 | 1/1935 | Edstrom | 51/177 |
| 2,014,627 | 9/1935 | Moorhead | 15/230 X |
| 2,230,312 | 2/1941 | Sieb et al. | 15/118 X |
| 2,268,015 | 12/1941 | Broberg | 15/49.1 |
| 2,819,478 | 1/1958 | Sutton | 15/230.19 X |
| 2,930,056 | 3/1960 | Lappin | 15/49.1 |
| 2,958,166 | 11/1960 | Foland | 51/358 |
| 3,047,897 | 8/1962 | Bartos et al. | 15/4 X |
| 3,082,451 | 3/1963 | Smithson | 15/4 |
| 3,113,331 | 12/1963 | Stabler | 15/50.1 |
| 3,527,001 | 9/1970 | Kleemeier et al. | 51/358 |
| 3,531,815 | 10/1970 | Moss et al. | 15/230.16 |
| 3,550,179 | 12/1970 | Brown et al. | 15/230 |
| 3,583,017 | 6/1971 | Davis | 15/98 |
| 3,793,665 | 2/1974 | Thielen | 15/180 |
| 3,795,932 | 3/1974 | Young | 15/230 X |
| 3,823,516 | 7/1974 | Christian | 51/358 |
| 3,990,124 | 11/1976 | Mackay, Jr. et al. | 15/230.15 X |
| 4,095,303 | 6/1978 | Armstrong et al. | 15/230 X |
| 4,186,459 | 2/1980 | Wulff | 15/49.1 X |
| 4,322,920 | 4/1982 | Wells | 15/246 X |
| 4,407,040 | 10/1983 | Scharf | 15/98 X |
| 4,418,438 | 12/1983 | Cutler | 15/230 |
| 4,580,308 | 4/1986 | Ashworth | 15/230.18 |
| 4,607,412 | 8/1986 | Ashworth | 15/230.18 |
| 4,961,243 | 10/1990 | Barber | 15/98 X |
| 4,998,314 | 3/1991 | Borofsky | 15/4 |
| 4,999,871 | 3/1991 | Plazanet | 15/98 X |

FOREIGN PATENT DOCUMENTS

| | | | |
|---|---|---|---|
| 38075 | 7/1909 | Austria | 15/230.15 |
| 1454295 | 9/1966 | France | 15/49.1 |
| 667902 | 9/1964 | Italy | 15/4 |
| 100535 | 12/1940 | Sweden | 15/230.19 |
| 355999 | 9/1931 | United Kingdom | 15/230 |

*Primary Examiner*—Harvey C. Hornsby
*Assistant Examiner*—Charles Cooley
*Attorney, Agent, or Firm*—Hopkins & Thomas

[57] ABSTRACT

A rotary clutch shaft of a floor machine removeably receives and rotates a brush block having downwardly protruding circumferentially arranged brushes protruding from the periphery of the brush block. Hooks which protrude from the bottom of the block, removeably retains a reversible, tufted, resilient, absorbent bonnet confined within the brushes and a frictional drive on the brush block engages the upper surface of the bonnet and rotates the bonnet as the block is rotated. The bonnet is readily removeable and can be laundered and reinstalled.

8 Claims, 3 Drawing Sheets

BRUSH AND BONNET CARPET CLEANING ASSEMBLY

This is a continuation of copending application Ser. No. 07/600,009 filed on Oct. 18, 1990, now abandoned and Ser. No. 07/823,022 filed on Jan. 15, 1992, now abandoned.

FIELD OF THE INVENTION

This invention relates to a brush and bonnet cleaning assembly and is more particularly concerned with a carpet cleaning system for scrubbing carpets with a brush and pad, simultaneously.

BACKGROUND OF THE INVENTION

In the past, carpets have been cleaned by using rotary floor machines which rotate bonnets having bristles protruding therefrom, the bristles engaging the carpet tufts as the machine is moved along a path by the operator. Other machines have utilized bonnets which are disposed beneath the rotating disk of a floor machine and which, after use, are removed from the floor and washed in water or detergent.

SUMMARY OF THE INVENTION

Briefly described, the present brush and bonnet assembly includes a combination of the rotary brush and the rotary bonnet, whereby the bonnet is surrounded by the brushes and the two are rotated simultaneously. The structure includes an annular brush block, the bottom outer periphery of which are provided with downwardly protruding brushes or bristles which are in an annular configuration beneath the brush block. Disposed within the cavity formed by the brushes is a flat, annular outer ring of cast rubber which has downwardly protruding pins or hooks for releaseably holding the bonnet in place. Inwardly of the cast rubber annular ring is a second smaller, annular ring formed of belting material having spaced parallel ridges which frictionally engage and rotate the bonnet. A removeable cap closes the central hole in the brush block and forms a central abuttment for the bonnet.

The upper surface of the brush block is provided with an annular upwardly opening groove which extends along the upper surface of the block, inwardly of the brushes. A plurality of circumferentially spaced holes, which communicate with the annular groove, are provided in the brush block. Thus, water from the floor machine can be received in the annular groove and will pass through the holes to be discharged onto the upper surface of the bonnet. Located centrally on the upper surface of the brush block is an upstanding hub provided with a central opening communicating with central opening of the brush block. This hub has a clutch plate on its upper surface which can be connected to and disconnected from a clutch shaft of the conventional floor machine. Thus, when the brush and bonnet assembly is driven by the floor machine, the brush block is rotated by the clutch shaft of the machine and thus both the bristles and the bonnet are simultaneously rotated.

The bonnet, itself, is a multi-layer fabric member having inner layers of unwoven felt and outer layers of tufted backing material.

Accordingly, it is an object of the present invention to provide a brush and bonnet assembly in which a bonnet may be easily installed and removed.

Another object of the present invention is to provide a brush and bonnet assembly in which the bonnet is maintained in a centered condition beneath the machine as the machine is operated.

Another object of the present invention is to provide a brush and bonnet assembly in which the brushes and bonnet will cooperate with each other so as to scrub the carpet and lift the tangled nap to restore the appearance of the carpet as the liquid and dirt on the carpet is retained for subsequent disposal.

Another object of the present invention is to provide a brush and bonnet assembly in which the thickness of the bonnet acts as a depth gauge to define how deeply the brushes or bristles of the assembly will penetrate into the carpeting.

Another object of the present invention is to provide, in a brush and bonnet assembly, a bonnet which can be reversed so as, selectively, to apply to the floor or carpet, one side of the bonnet or the other.

Another object of the present invention is to provide a brush and bonnet assembly which is capable of receiving liquid from a floor machine, regardless of whether the liquid is fed from a central opening or from location spaced from the center of rotation of the assembly.

Another object of the present invention is to provide a brush and bonnet assembly which is capable of operating either as a dry system or as a wet system.

Another object of the Present invention is to provide a brush and bonnet assembly wherein the bonnet is removeably retained within the brushes or bristles of the assembly, as the machine is tilted.

Another object of the present invention is to provide a brush and bonnet assembly wherein the bonnet may be readily and easily periodically removed and installed, as desired.

Another object of the present invention is to provide a brush and bonnet assembly which is inexpensive to manufacture, efficient in operation and durable in structure.

Another object of the present invention is to provide a brush and bonnet assembly which can use brushes and a fabric pad in conjunction with each other to quickly clean carpet and leave it in a clean and dry condition.

Another object of the present invention is to provide a brush and bonnet assembly in which the bonnet is positively driven by the machine and yet remains centered in the machine and is readily removeable from the machine.

Other objects, features and advantages of the present invention will become apparent from the following description when considered in conjunction with the accompanying drawings wherein like characters of reference designate corresponding parts throughout the several views.

DETAILED DESCRIPTION

Figure 1:
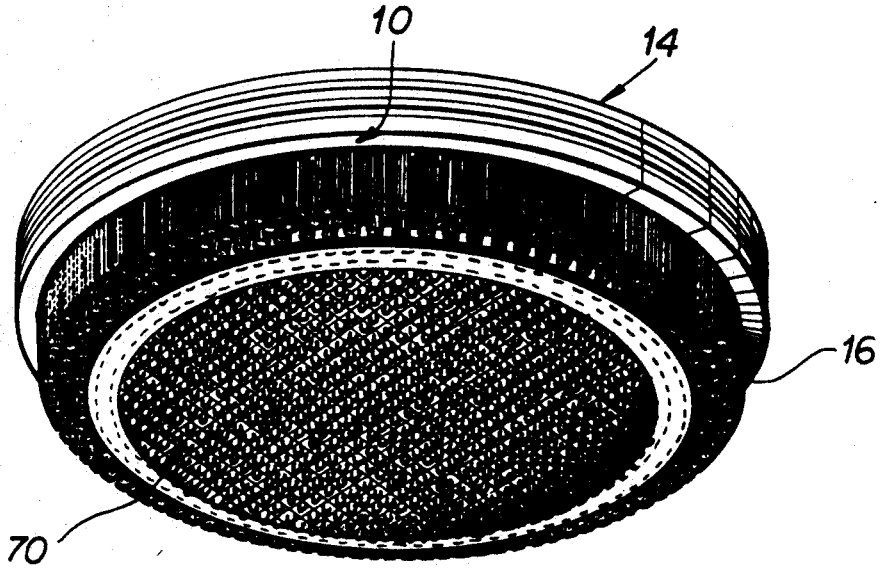
FIG. 1 is a perspective view of a brush and bonnet assembly constructed in accordance with the present invention.

Referring now in detail to the embodiment chosen for the purpose of illustrating the present invention, numeral 10 denotes generally a circular, disc-shaped, annular brush block or plate provided with an outer periphery 11 and an inner periphery 12. The inner periphery 12 defines a central opening 9. The brush block 10 is thus concentric about a vertical axis $\alpha$ and is provided with a flat or planar upper surface 112 and a flat or planar lower surface 13.

Figure 4:
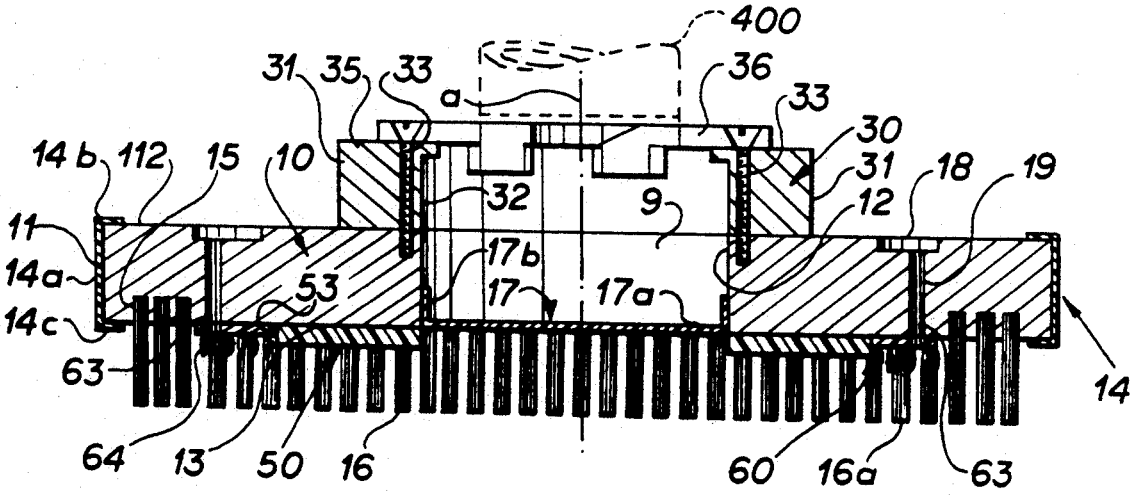
FIG. 4 is a cross-sectional view substantially along line 4—4 in FIG. 3, the clutch shaft of a floor machine being shown in broken lines and spaced from the brush and bonnet assembly.
Figure 5:
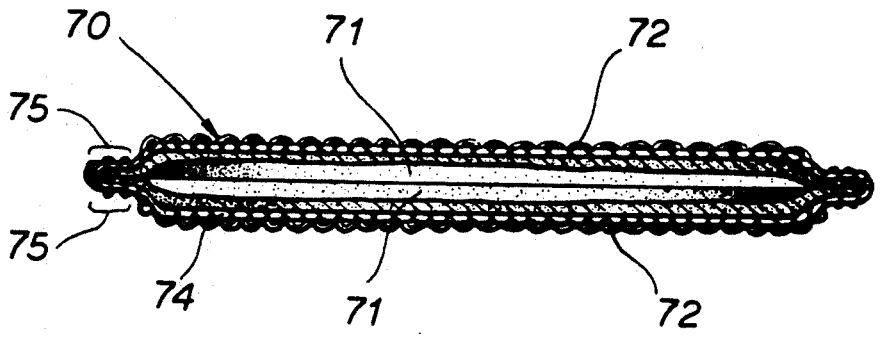
FIG. 5 is a cross-sectional view taken substantially along line 5—5 in FIG. 3.

Extending around the circular outer periphery 11 of the brush block 10 is a resilient, removeable bumper ring 14. This bumper ring 14 is preferably formed of rubber or flexible plastic material and, in cross-section, as seen in FIG. 4 includes an annular body portion **14*a*, an upper, inwardly protruding, annular flange 14*b*, which protrudes from the upper edge of the body 14*a*, and a lower, inwardly protruding, annular flange 14*c*. The body 14*a* of the bumper 14 is of a vertical height substantially equal to the width of the brush plate 10 so that the upper flange 14*b* extends inwardly over the upper outer peripheral surface 112 of the brush block or plate 10 and the lower flange 14*c* protrudes inwardly below the lower surface 13 of the brush block or plate 10. The bumper ring 14 is sufficiently resilient that it can be readily and easily removed from and installed on the peripheral edge portion of the brush plate 10, as desired. The function of the bumper ring 14 is to prevent the block 10** from damaging any object which it may engage.

Figure 2:
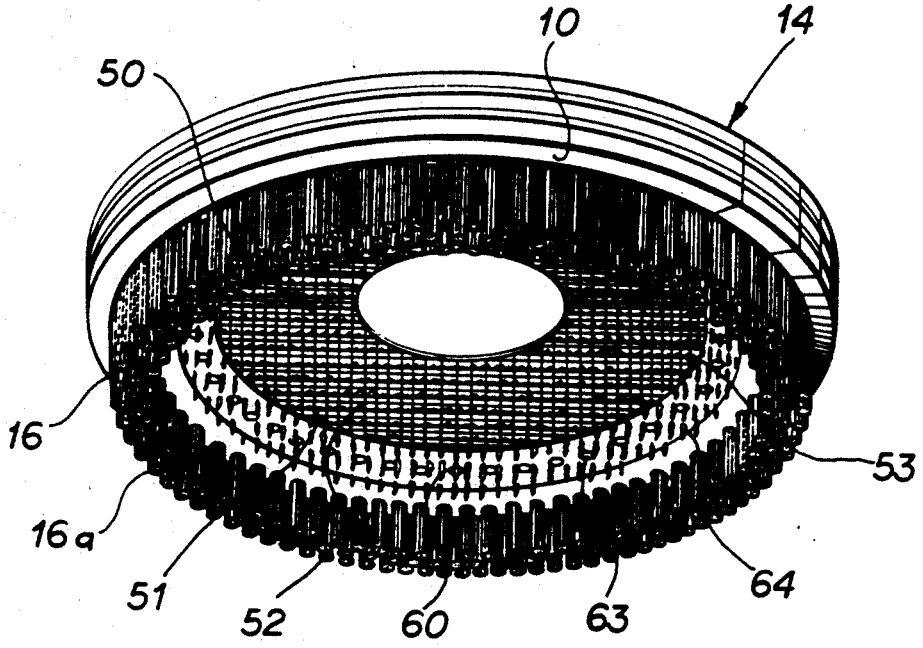
FIG. 2 is a perspective view similar to FIG. 1 and showing the brush assembly, without the bonnet.
Figure 3:
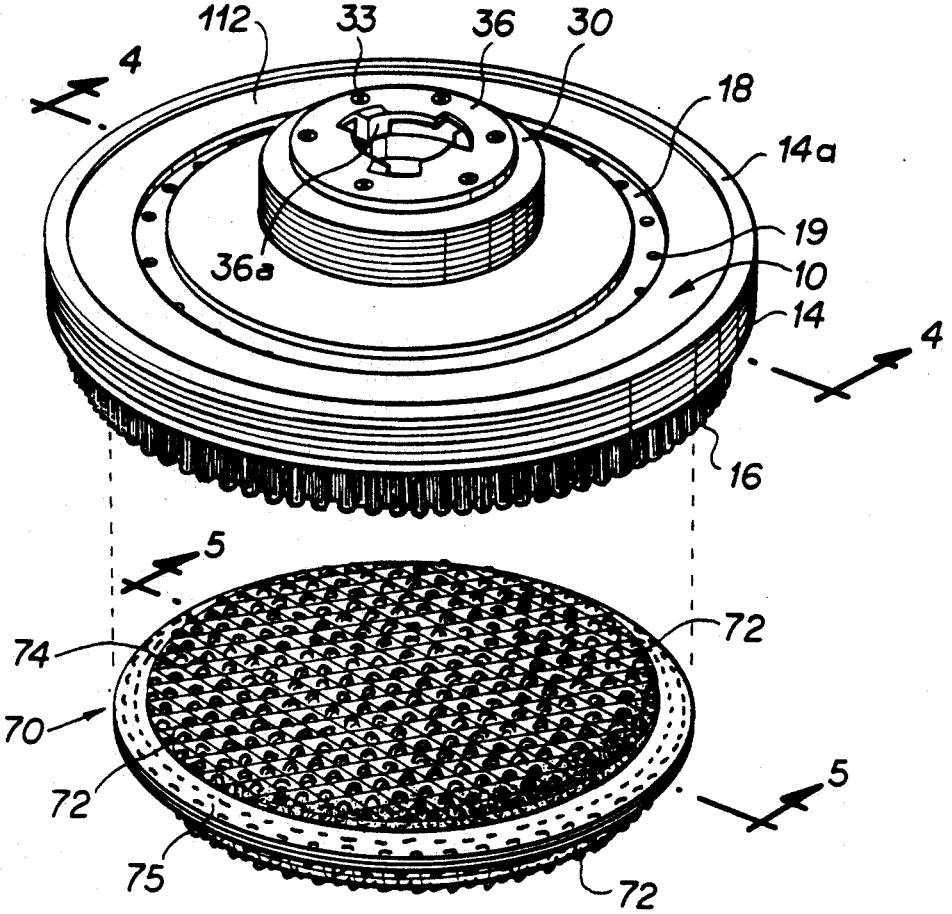
FIG. 3 is an exploded perspective view of the brush and bonnet assembly shown in FIG. 1.

Inwardly of the outer periphery 11 and ring 14, the outer peripheral portion of the lower surface 13 is provided with a plurality of inwardly protruding holes 15 which are sunk so as to be parallel to axis $\alpha$ and perpendicular to the upper and lower surfaces 112 and 13 of the brush block or plate 10. Nylon bristles or brushes 16 are respectively secured by their proximal end portions in the holes 15. Preferably the holes 15 are arranged in three concentric circular equally spaced rings of holes 15, the holes 15 of the respective three rows or rings being aligned radially with each other and being spaced circumferentially from the next group of radially aligned holes 15 so that the bristles 16 are respectively radially aligned in groups of three and circumferentially spaced from each other around the periphery, as best seen in FIGS. 2 and 4. The bristles 16 all protrude in a radial or perpendicular direction away from the bristle block or plate 10 and terminate so that their distal ends **16*a* which are in a common radial plane, parallel to and spaced from and disposed below the lower surface 13. The innermost ring of bristles thus defines, with the bristle block 10, a cup-like cavity which is adapted to receive the bonnet, denoted generally by numeral 70**.

Disposed within the hollow central portion defined by the inner periphery 12 of the brush block 10 is a removeable, press fitted cap 17. This cap 17 includes a flat, circular, disc-shaped web **17*a* having an upstanding outer peripheral shoulder 17*b* which frictionally engages the inner periphery 12 of plate 10. The cap 17 can be readily removed from and installed in the central opening 9 defined by the inner periphery 12**.

Secured to the central upper surface 112 of the brush block or plate 10 is an upstanding, annular, central hub or riser 30 having an outer periphery 31 and an inner periphery 32. The inner periphery 32 is the same diameter as the inner periphery 12 of plate 10 and is disposed in concentric alignment with inner periphery 12. Circumferentially spaced bolts 33, seen in FIG. 4, secure the hub 30 onto the upper surface 112 of plate 10.

Figure 6:
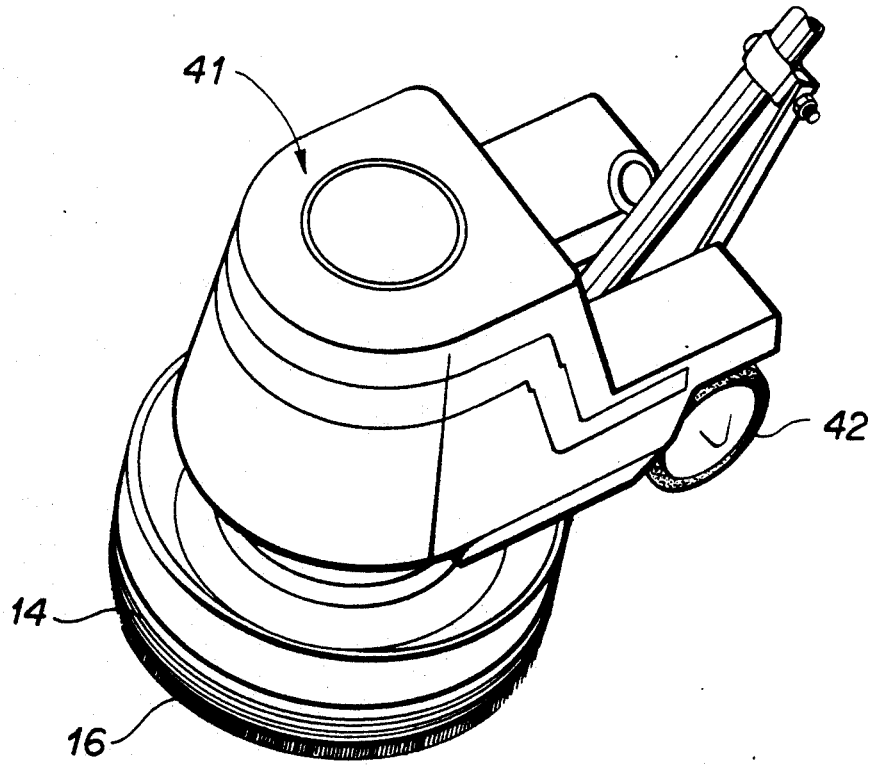
FIG. 6 is a perspective view of the brush and bonnet assembly attached to a conventional floor machine.

Disposed on the upper surface 35 of the hub 30 is a conventional, universal clutch plate 36, the bolts or screws 33 passing through the clutch plate 36 so that the heads of screws 33 are flush with the upper surface of the clutch plate 32. Thus, the bolts or screws 33 secure the clutch plate 32, the hub 30 and the brush plate 10 together in concentric alignment about axis $\alpha$. The interior of the clutch plate 36 is provided with conventional lugs **36*a* by which the clutch plate is removeably secured to the end portion of a clutch shaft 40, denoted generally by broken lines in FIG. 4. The clutch shaft 40 forms a portion of the floor machine 41 seen in FIG. 6. The clutch plate 36 enables the brush and bonnet assembly to fit most any floor machine 41, whereby the assembly is rotated about axis $\alpha$. The conventional floor machine 41 has transportation wheels 42 by which the machine 41 may be pivoted so as to incline the clutch shaft 400 at an angle and permit ready access to the clutch shaft 400** for installing and removing the brush and bonnet assembly.

Outwardly of the hub 30 and inwardly of the outer periphery 11, the upper surface 112 of the brush block 10 is provided with a continuous, circular trough or groove denoted generally by numeral 18. A plurality of circumferentially, equally spaced holes or passageways 19 are provided in the brush plate 10, each of the holes being disposed vertically and passing through the brush plate 10 so as to communicate at its upper end portion with the groove 18 and so as to open downwardly at the lower surface 13. An appropriate nozzle 400 not shown of the floor machine is adapted to align with the trough 18 so as to receive liquid which, thence, passes downwardly through the holes or passageways 19 and is discharged as a shower, in a downward direction from the lower ends of the passageways 19.

On the lower surface 13 of the brush block or plate 10 and concentric with the axis $\alpha$ is friction drive member, denoted generally by the numeral 50. This drive member 50 is flat, flexible, resilient, friction disc, cut from heavy rubber having a polyester reinforced substrate. This belting material is such that the resulting drive member 50 has along its lower surface a plurality of spaced parallel ribs 51, the ribs 51 being arranged alternately with parallel valleys 52, therebetween. The inner surface of the annular drive member 50 is adhered to the lower surface 13 of the plate or block 10. The outer periphery 53 of drive member 50 terminates inwardly of the passageways 19 and thus, inwardly of the inner ring of bristles 16.

Between the inner ring of bristles 16 and the outer periphery of the friction driving member 50 is a unitary molded, rubber, hook ring 60, the ring 60 having an inner periphery abutting the outer periphery 53 of the friction drive member 50. The outer periphery of the ring 60 terminates inwardly of the inner ring of brushes 16. The inner surface of the molded hook ring 60 is adhered to the bottom surface of the brush block or plate 10, there being provided holes 63 in the ring 60, which are respectively aligned with the passageways 19 so as to permit the discharge of liquid downwardly through such holes 63.

A plurality holding of elements such as needle-like lock grip hooks 64 protrude downwardly from the lower surface of the ring 60, these hooks 64 terminating at about the plane of the outer surface of the friction drive member 50.

The bonnet 70 is a disc-shaped, flexible member formed of absorbent or hydrophilic material and is of a diameter slightly less than the diameter of the inner ring of brushes 16. Thus, this bonnet 70 can be received within the bristles 16 so that the inner surface or upper surface of the bonnet 70 is engaged and yieldably retained by the hooks 64.

The bonnet 70 is formed of a plurality of inner layers of fabric, there being preferably two disc-shaped inner layers 71 and two disc-shaped outer layers 72. The inner layers 71 are disc-shaped, flat, flexible pads, respectively formed of a blended yarn or cotton fiber. Each pad 71 is preferably made from a blended yarn of unwoven material or felt. Thus, the inner core is formed of a plurality of absorbent material pads stacked one on top of the other.

Each outer layer 72 is a tufted fabric which includes a backing material formed of a porous plastic material in which are formed rows of loops or tufts 74, the yarns therefor being of cotton or rayon and polyester. The tufts 74 are preferably loop pile tufts so that the hooks 64 will hold the bonnet 70 by engaging the loop piles 74.

The outer layers 72 are of larger diameter than the inner layers 71 and therefore overlie and encompass the inner core.

In the assembly of the bonnet 70, the periphery of an inner layer is stitched to the periphery of an outer layer 72. The two sections are then stitched together and as a last step, the overlapping peripheral portions of the outer layers 72 are provided with serging tape 75 around the upper and lower peripheries thereof, the tape being stitched to the outer surface of each pad and the outer peripheries of the two backing materials are brought together and stitched together around the periphery.

The inner felted material is quite absorbent as are outer layers 72 particularly the tufts 74 of the bonnet. The hooks 64 function to engage the tufts 74 sufficiently so that the bonnet 70, once installed within the cavity defined by the brushes 16, will be retained in place even though the machine 41 is in a tilted condition.

Instead of the hydrophilic surface or surfaces formed by the outer layers 72 of bonnet 70, the bonnet 70 may be provided with one or two abrasive surfaces, suitable for removing paints, enamels or lacquers from the surface of a floor.

The thickness of the bonnet 70 is such that the bonnet 70 normally protrudes beyond the plane of the distal ends of the brushes 16 so that pressure must be applied to the machine 41 for the brushes 16 to be brought down into engagement with the tufts or piles in the carpeting which is being cleaned. Due to the fact that the bonnet 70 carries most of the weight of the machine 41, the tilting of the machine 41 will control the depth of penetration of the bristles or brushes 16 into the carpeting. Furthermore, a cleaning solution can be fed from the machine into the trough 18 so that it is sprayed onto the carpeting and will be absorbed by the bonnet 70 when it passes over the wet surface. The weight of the machine 41 as well as the manual tilting of the machine 41 will urge the friction drive member 50 against the surface of the bonnet 70 and thereby assure that the bonnet 70 rotates at the same speed as the block 10. The hooks 64 are primarily for the purpose of holding the bonnet 70 in place centered below the block 10. The loops or tufts 74 engage the hooks 64 in much the same manner as VELCRO® acts and thus the bonnet 70 may be readily removed from the hooks 64, even though the hooks 64 will center the bonnet 70, until it is urged out of the cavity defined by the brushes 16.

The bonnet may be washed from time-to-time and indeed passed through a wringer, if desired, so as to remove the accumulated liquid and dirt.

The brushes 16 can be quite flexible or can be quite rigid, as desired. The brushes 16 should be from about 18 denier to about 30 denier in size.

In operation, the combined action of the brushes 16, the hooks 64 and the friction drive member 50 cooperate to maintain the bonnet 70 in a centered position beneath the brush block 10. The combined action of the bristles 16 and the Pad or bonnet 70 provide a scrubbing action as well as a wiping action wherein the bristles 16 lift the nap and restore the appearance of the carpet and bonnet 70 wipes and absorbs dirt and liquid from the carpeting, thereby leaving the carpeting in a dry condition.

The bonnet 70 can be turned over since it is symmetrical and can be readily removed when it is desired to substitute one bonnet for the other or simply to wash or wring out the bonnet.

Liquid can be injected through the machine 41 into the trough 18 or it can be inserted through the central opening, in the event that the cap 17 is removed.

The assembly can be used either for a dry system or for a wet system of cleaning. The dry system may include applying some dry chemical to the surface of the carpeting. This dry material is worked by the brushes and then swept up and retained by the tufts of the bonnet 70. The hooks 64 function to retain the bonnet in its centered position, even if the machine 41 is tilted and transported to another area of the carpeting.

the friction drive member 50 is never permanently secured to the bonnet 70 but simply frictionally engages the outer layer 74, primarily the tufts 74 of the outer layers 72 and, thus, the bonnet 70 is only retained by its outer peripheral portion by means of the hooks 64 engaging the loops 74. Thus, the bonnet 70 while being held concentrically in the cavity and within the brushes 16, can be quite readily removed from its cavity, when desired.

The brush and bonnet assembly can also be used on a hard surface for either cleaning or abrading the hard surface.

It will be obvious to those skilled in the art that many variations may be made in the embodiment here chosen for the purpose of illustrating the preferred embodiment of the invention, without departing from the scope thereof as defined by the appended claims.

I claim:

1. A brush and bonnet carpet cleaning assembly comprising:

(a) a circular brush block having a central axis of rotation, an upper surface, a lower surface and a peripheral portion;

(b) a plurality of brushes carried by said brush block, said brushes being spaced from said axis and being secured by their proximal end portions to the peripheral portion of said brush block, said brushes extending around said axis, said brushes protruding from the peripheral portion of said brush block in an axial direction away from said brush block and terminating in distal ends which are in a common radial plane and are spaced from said brush block, said brushes and block defining a bonnet receiving cavity circumscribed by said brushes;

(c) drive means fixed to said lower surface of said brush block for rotating with said brush block about said axis as the peripheral portion of said brush block moves with said brushes in an orbital path around said axis when said brush block is rotated, said drive means having a lower bonnet engaging surface;

(d) a reversible compressible bonnet having a peripheral portion, an inner portion, and opposite surfaces for selectively being positioned so that one surface is selectively disposed for forming a bottom surface for engaging the carpet and the other surface forms an upper surface in contact with said lower bonnet engaging surface of said drive means, said bonnet being rotatable by said drive means when said block is rotated, said bonnet being confined by said brushes wholly within said receiving cavity, said bonnet being formed of flexible compressible hydrophilic material and having tufts of hydrophilic yarns along said surfaces of said bonnet, said bonnet, when received within said bonnet receiving cavity having said upper surface of said bonnet in contact with said bonnet engaging surface, said bonnet being of sufficient thickness that when said bonnet is within said recess and said bonnet engaging surface engages said upper surface of said bonnet, said bonnet extends away from said lower surface of said brush block by a distance greater than the length of that portion of said brushes which protrude from said brush block and so that the lower surface of said bonnet is in a plane below said common radial plane for supporting said brushes with their distal ends spaced away from the carpet sufficiently for the ends of said brushes to be free of said carpet until said brush block is tilted; and (e) holding elements protruding from said block for engaging the tufts of either surface of said opposite surfaces of said bonnet which forms said upper surface of said bonnet for causing said bonnet to be held within said bonnet receiving cavity when said block is lifted away from the carpet and to be rotated about said axis when said block and said brushes are rotated.

2. The brush and bonnet assembly defined in claim 1 wherein said brush block is provided with a central opening which is adapted to communicate with a floor machine, and a removable central cap on said brush block for selectively closing said central opening, said central opening providing a passageway through which liquid is introduced to said bonnet for wetting the bonnet.

3. The brush and bonnet assembly defined in claim 1 wherein said holding elements comprise hooks disposed in the bonnet receiving cavity, said hooks being located radially inwardly of said brushes and secured to the lower surface of said brush block for yieldably retaining the peripheral portion of said bonnet in said cavity.

4. A brush and bonnet carpet cleaning assembly comprising:

(a) a circular brush block having a central axis of rotation, an upper surface, a lower bonnet engaging surface and a peripheral portion;

(b) a plurality of brushes carried by said brush block, said brushes being spaced from said axis and being secured by their proximal end portions to the peripheral portion of said brush block, said brushes extending around said axis, said brushes protruding from the peripheral portion of said brush block in an axial direction away from said brush block and terminating in distal ends which are in a common radial plane and are spaced from said brush block, said brushes and block defining a bonnet receiving cavity circumscribed by said brushes;

(c) means connected to said brush block for rotating said brush block about said axis so that the peripheral portion of said brush block moves with said brushes in an orbital path around said axis when said brush block is rotated;

(d) a reversible compressible bonnet having a peripheral portion, an inner portion, and opposite surfaces for selectively being positioned so that one surface is selectively disposed for forming a bottom surface for engaging the carpet and the other surface forms an upper surface, said bonnet being removeable received wholly within said receiving cavity, said bonnet being formed of flexible compressible hydrophilic material and having tufts of hydrophilic yarns along surfaces of said bonnet, said bonnet, when received within said bonnet receiving cavity having said upper surface of said bonnet in contact with said bonnet engaging surface, said bonnet being of sufficient thickness that it extends from said brush block by a distance greater than the length of that portion of said brushes which protrude from said brush block and so that the lower surface of said bonnet is in a plane below said common radial plane for supporting said brushes with their distal ends spaced away from the carpet sufficiently for the ends of said brushes to be free of said carpet until said brush block is tilted; and (e) holding elements protruding from said block for engaging the tufts of said upper surface of said bonnet for causing said bonnet to be rotated about said axis when said block and said brushes are rotated;

wherein said bonnet engaging surface is a friction driving member disposed along a central portion of the lower surface of said brush block, said brushes surrounding said friction driving member, said friction driving member contacting the upper surface of said bonnet radially inwardly of said holding elements.

5. A brush and bonnet carpet cleaning assembly comprising:

(a) a circular brush block having a central axis of rotation, an upper surface, a lower bonnet engaging surface and a peripheral portion;

(b) a plurality of brushes carried by said brush block, said brushes being spaced from said axis and being secured by their proximal end portions to the peripheral portion of said brush block, said brushes extending around said axis, said brushes protruding from the peripheral portion of said brush block in an axial direction away from said brush block and terminating in distal ends which are in a common radial plane and are spaced from said brush block, said brushes and block defining a bonnet receiving cavity circumscribed by said brushes;

(c) means connected to said brush block for rotating said brush block about said axis so that the peripheral portion of said brush block moves with said brushes in an orbital path around said axis when said brush block is rotated;

(d) a reversible compressible bonnet having a peripheral portion, an inner portion, and opposite surfaces for selectively being positioned so that one surface is selectively disposed for forming a bottom surface for engaging the carpet and the other surface forms an upper surface, said bonnet being removeable received wholly within said receiving cavity, said bonnet being formed of flexible compressible hydrophilic material and having tufts of hydrophilic yarns along surfaces of said bonnet, said bonnet, when received within said bonnet receiving cavity having said upper surface of said bonnet in contact with said bonnet engaging surface, said bonnet being of sufficient thickness that it extends from said brush block by a distance greater than the length of that portion of said brushes which protrude from said brush block and so that the lower surface of said bonnet is in a plane below said common radial plane for supporting said brushes with their distal ends spaced away from the carpet sufficiently for the ends of said brushes to be free of said carpet until said brush block is tilted; and (e) holding elements protruding from said block for engaging the tufts of said upper surface of said bonnet for causing said bonnet to be rotated about said axis when said block and said brushes are rotated;

wherein said bonnet engaging surface includes a central annular frictional drive means on the lower surface of said block for engaging the upper surface of said bonnet and wherein said holding elements include straight, downwardly protruding elements which protrude from the lower surface of said brush block, said elements being disposed radially outwardly of said frictional drive means for engaging the peripheral portion of said bonnet for removeable retaining said bonnet in place within said cavity, said brushes being disposed radially outwardly of said elements.

6. A brush and bonnet carpet cleaning assembly comprising:

(a) a disc-shaped brush body having a lower surface, said body being rotatable about a vertical axis;

(b) a plurality of brushes protruding in an axial direction from said brush body, said brushes being disposed in a circle around said axis and adjacent the periphery of said body, said brushes having an inner peripheral defining, with said body, a central bonnet receiving cavity;

(c) a resilient flexible water absorbent fabric bonnet removeably received within said cavity, said bonnet having an upper surface and a lower surface;

(d) a plurality of holding elements protruding from the lower surface of said body, said holding elements being disposed radially inwardly of said inner periphery of said brushes for removeably engaging said bonnet by protruding into the upper surface of said bonnet, said holding elements retaining said bonnet within said cavity, said bonnet and said holding elements being rotated with said body about said axis, said holding elements also retaining said bonnet in place when said body is tilted;

(e) said body being provided with a plurality of circumferentially spaced passageways passing through said body; and (f) said body being provided with an upwardly opening, circumferential channel communicating with said passageways for supplying liquid introduced into said channel through said passageways and to said bonnet;

wherein said bonnet is circular and has a peripheral portion, said holding elements being disposed in a ring for engaging the peripheral portion of said bonnet and a frictional drive member is secured to said lower surface of said body radially inwardly of said holding elements for engaging the central portion of said bonnet for rotating said bonnet with said body.

7. The carpet cleaning assembly defined in claim 6 wherein said frictional drive member is composed of rubber.

8. The carpet cleaning member defined in claim 7 wherein said frictional drive member has spaced ribs.

* * * * *